US006868377B1

(12) United States Patent
Laroche

(10) Patent No.: US 6,868,377 B1
(45) Date of Patent: Mar. 15, 2005

(54) MULTIBAND PHASE-VOCODER FOR THE MODIFICATION OF AUDIO OR SPEECH SIGNALS

(75) Inventor: Jean Laroche, Santa Cruz, CA (US)

(73) Assignee: Creative Technology Ltd., Singapore (SG)

( * ) Notice: Subject to any disclaimer, the term of this patent is extended or adjusted under 35 U.S.C. 154(b) by 0 days.

(21) Appl. No.: 09/448,540

(22) Filed: Nov. 23, 1999

(51) Int. Cl.[7] ..... G10L 19/02
(52) U.S. Cl. ..... 704/205; 704/211; 341/111
(58) Field of Search ..... 704/205, 207, 704/211, 258, 268, 269; 375/364; 341/111

(56) References Cited

U.S. PATENT DOCUMENTS

| | | | | | |
|---|---|---|---|---|---|
| 3,936,611 | A | * | 2/1976 | Poole | 704/503 |
| 3,995,116 | A | * | 11/1976 | Flanagan | 704/267 |
| 4,246,617 | A | * | 1/1981 | Portnoff | 360/32 |
| 4,630,300 | A | * | 12/1986 | Kang et al. | 704/205 |
| 4,817,146 | A | * | 3/1989 | Szczutkowski et al. | 380/261 |
| 4,959,863 | A | * | 9/1990 | Azuma et al. | 380/275 |
| 5,073,938 | A | * | 12/1991 | Galand | 704/207 |
| 5,226,108 | A | * | 7/1993 | Hardwick et al. | 704/200 |
| 5,414,795 | A | * | 5/1995 | Tsutsui et al. | 704/204 |
| 5,566,154 | A | * | 10/1996 | Suzuki | 369/59.26 |
| 5,664,051 | A | * | 9/1997 | Hardwick et al. | 704/268 |
| 5,687,240 | A | | 11/1997 | Yoshida et al. | |
| 5,737,367 | A | * | 4/1998 | Wuppermann et al. | 375/242 |
| 5,737,717 | A | * | 4/1998 | Akagiri et al. | 704/200.1 |
| 5,848,164 | A | * | 12/1998 | Levine | 704/278 |
| 6,112,169 | A | | 8/2000 | Dolson | |
| 6,323,797 | B1 | * | 11/2001 | Kikumoto et al. | 341/144 |
| 6,580,795 | B1 | * | 6/2003 | Li et al. | 379/406.14 |
| 6,766,300 | B1 | * | 7/2004 | Laroche | 704/500 |

OTHER PUBLICATIONS

Laroche et al., "Improved phase vocoder time–scale modification of audio," IEEE Transactions on Speech and Audio Processing, vol. 7, No. 3, May 1999, pp. 323 to 332.*

Laroche et al., "Phase–vocoder: About this phasiness business," 1997 IEEE ASSP Workshop on Applications of Speech Processing to Audio and Acoustics, Oct. 1997, 4 pages.*

Allen et al. "A Unified Approach to Short–Time Fourier Analysis and Synthesis," Proc. IEEE 65:1558–1564 (1977).

Bershad "Analysis of the Normalized LMS Algorithm with Gaussian Inputs," IEEE Transactions on Acoustics, Speech, and Signal Processing 34:793–806 (1986).

Ferreira "An odd–DFT based approach to time–scale expansion of audio signals," IEEE Transactions on Speech and Audio Processing.7:441–453 (1999).

Flanagan et al. "Phase vocoder," Bell Syst. Tech. J. 45:1493–1509 (1966).

(List continued on next page.)

*Primary Examiner*—Richemond Dorvil
*Assistant Examiner*—Martin Lerner
(74) *Attorney, Agent, or Firm*—Schwegman, Lundberg, Woessner & Kluth, P.A.

(57) ABSTRACT

A method and apparatus to inexpensively and efficiently process audio and speech signals. A method for processing a signal having at least one region of interest is provided. The method begins by dividing the signal into a plurality of sub-band signals, wherein a selected sub-band signal includes the region of interest. The selected sub-band is processed by a phase vocoder to produce a vocoder output signal. Next, at least a portion of the subbands are time-aligned with the vocoder output signal. Finally, the aligned sub-band signals and the vocoder output signal are combined to form an output signal.

11 Claims, 3 Drawing Sheets

OTHER PUBLICATIONS

George et al. "Analysis–By–Synthesis/Overlap–Add Sinusoidal Modeling Applied to the Analysis and Synthesis of Musical Tones," J. Audio Eng. Soc. 40:497–516 (1992).

Laakso et al. "Splitting the Unit Delay," IEEE Signal Processing Mag., 13:30–60 (1996).

Laroche "Time and pitch scale modification of audio signals," in *Applications of Digital Signal Processing to Audio and Acoustics,* M. Kahrs and K. Brandenburg eds., Kluwer, Norwell, MA, (1998).

Marques et al. "Harmonic Coding at 4.8 KB/S," Proc. IEEE Int. Conf. Acoust., Speech, Signal Processing 1:17–20, (1990).

Moulines et al. "Non parametric techniques for pitch–scale and time–scale modification of speech," Speech Communication 16:175–205 (1995).

Portnoff "Time–scale modifications of speech based on short–time Fourier analysis," IEEE Trans. Acoust., Speech, Signal Processing 29:374–390 (1981).

Puckette "Phase–locked vocoder" Proc. Proc. IEEE ASSP Workshop on App. of Sig. Proc. to Audio and Acous., New Paltz, NY (1995).

Putnam et al. "Design of Fractional Delay Filters Using Convex Optimization," Proc. IEEE ASSP Workshop on App. of Sig. Proc. to Audio and Acous., New Paltz, NY (1997).

Serra et al. "Spectral Modeling Synthesis: a Sound Analysis/Synthesis System Based on a Deterministic Plus Stochastic Decomposition," Computer Music J. 14:12–24 (1990).

Smith et al. "A flexible Sampling–Rate Conversion Method," Proc. IEEE Int. Conf. Acoust., Speech, Signal Processing, San Diego, CA, Mar. 1984.

Valimaki et al. "Fractional Delay Digital Filters" Proc. IEEE Int. Symposium on Circuits and Systems, Chicago, IL (1993).

Williamson et al. "Fir Approximation of Fractional Sample Delay Systems," IEEE Trans. Circuit and Syst.–II 43:269–271 (1996).

Almeida, et al., "Variable–Frequency Synthesis: An Improved Harmonic Coding Scheme," Proc. IEEE Int. Conf. Acoust., Speech, Signal Processing, pp. 27.5.1–27.5.4 (1984).

McAulay, et al., "Speech Analysis/Sythesis Based on a Sinusoidal Representation," IEEE Trans. Acoust., Speech, Signal Processing, vol. ASSP–34, No. 4, pp. 744–754 (1986).

Tassart et al., "Analytical Approximations of Fractional Delays: Lagrange Interpolators and Allpass Filters," Proc. IEEE Int. Conf. Acoust., Speech, Signal Processing, Munich, Germany (1997).

* cited by examiner

MULTIBAND PHASE-VOCODER FOR THE MODIFICATION OF AUDIO OR SPEECH SIGNALS

FIELD OF THE INVENTION

This invention relates generally to signal processing, and more particularly, to a multiband phase-vocoder for processing audio or speech signals.

BACKGROUND OF THE INVENTION

The phase-vocoder has long been a popular tool for high-quality audio effects such as time-scaling, pitch-shifting, analysis/modification/synthesis and so on.

The phase-vocoder is based on calculating Fast Fourier Transforms of overlapping windowed portions of an incoming signal, processing the frequency-domain representation thus obtained, and re-synthesizing an output signal by means of overlapping windowed inverse Fourier transforms. In practice, the bulk of the computation cost lies in the calculations of the (usually) large Fourier transforms (for a 48 kHz audio signal, 4096 point Fourier transforms are typical). The Fourier transforms yield a convenient decomposition of the signal into frequency channels that span the entire frequency range from 0.0 Hz to half the sampling rate. This is usually more than one really needs. For example, audio signals typically have most of their energy in the low frequency area (between 0.0 and 12 kHz for example) and the high-frequencies usually contain incoherent signals (such as noise, transients and so on). Unfortunately, the standard phase-vocoder operates on the entire frequency region, which means that a significant fraction of the computation cost is spent to no benefit.

SUMMARY OF THE INVENTION

The present invention offers a way to minimize the computation cost of the phase-vocoder by splitting the incoming signal into a small number of subbands (say 2 to 4) spanning the whole frequency range, and only running the phase vocoder on the signals in the subbands of interest. The other subbands can be processed using different techniques (usually better suited to the kind of signals in these subbands, and also usually much cheaper than the phase-vocoder). Finally, the processed subband signals are merged into the output signal. In practice, the additional cost of the subband splitting is largely offset by the significant savings in the phase-vocoder stage, the savings resulting from the fact that the subband signals have a lower sampling rate than the original signal and can be processed by the phase-vocoder more efficiently.

In one embodiment of the present invention, a method for processing a signal having at least one region of interest is provided. The method begins by dividing the signal into a plurality of sub-band signals, wherein a selected sub-band signal includes the region of interest. The selected sub-band is processed by a phase vocoder to produce a vocoder output signal. Next, at least a portion of the subbands are time-aligned with the vocoder output signal. Finally, the aligned sub-band signals and the vocoder output signal are combined to form an output signal.

DESCRIPTION OF THE SPECIFIC EMBODIMENTS

The following description describes a system to inexpensively and efficiently process audio and speech signals, wherein a computationally expensive phase-vocoder operates only on selected regions of interest in the input signal.

The invention includes a method for processing a time domain input signal according to the following steps. First, the input signal is split into several time-domain signals corresponding to adjacent frequency subbands. Next, a phase-vocoder processes one or more of the time-domain subband signals. In the meantime, the other time-domain subband signals can be processed by other means. Finally, the processed subband signals are recombined into an output signal.

Figure 1:
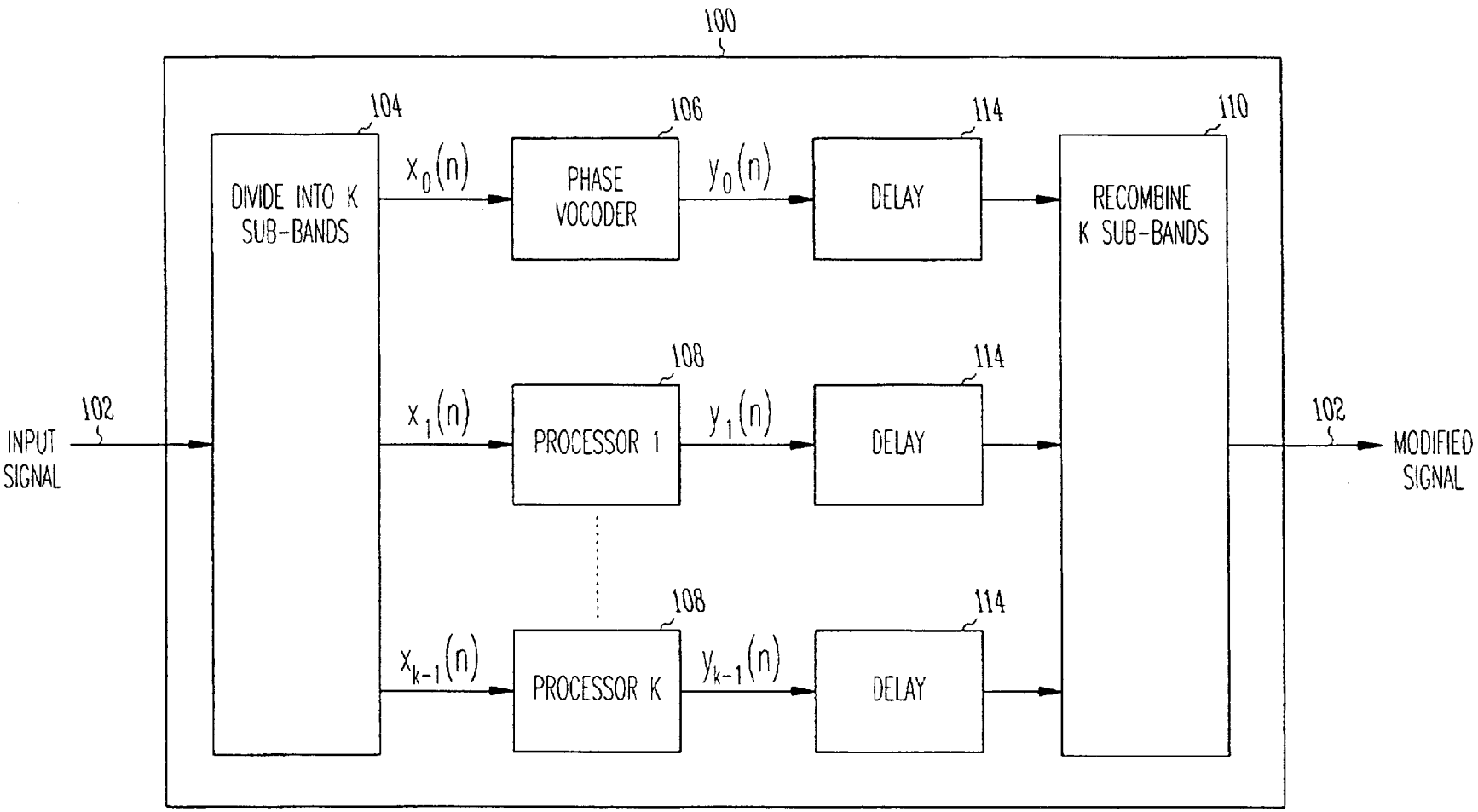
FIG. 1 shows a block diagram of a subband phase-vocoder constructed in accordance with the present invention.

FIG. 1 shows a block diagram of subband phase-vocoder 100 constructed in accordance with the present invention. In FIG. 1, a time domain input signal 102 is split into K time-domain subband signals by an analysis filter bank 104. The first subband, namely $x_0(n)$, is processed using phase-vocoder 106. The remaining subbands are processed by up to K processors shown at 108. The processed subband signals are recombined at a synthesis filter bank 110 into an output signal 112. Optional delay blocks 114 may be used to compensate for delays introduced by the phase-vocoder and the processors.

The analysis filter bank 104 splits the incoming time domain signal 102 into K subband signals ($X_0(n)$–$X_{k-1}(n)$). The synthesis filterbank 110 reconstructs the processed subband signals to form the output signal 112. Any type of analysis and synthesis filterbanks can be used, such as perfect-reconstruction or linear-phase filterbanks. However, such filterbanks are not a requirement, since the signals are to be modified anyway, and a certain degree of alteration can be tolerated. Cost effective IIR filterbanks are attractive for their high performance and low computation cost, and their phase non-linearity is usually not a significant problem in the kind of applications that use the phase-vocoder.

In practice, the subbands signals are downsampled to a sampling rate much lower than the input signal's sampling rate. For example, a 2-band analysis filterbank can output 2 subband signals at half the original sampling rate. The downsampling stage is usually included in the analysis filterbank 104, however, it is not shown in FIG. 1.

Because the signal has been split into the subband time-domain signals $x_k(n)$, each of the subband signals can be processed using the most appropriate technique. For example, when time-scaling audio signals, one can chose to process the signal in the lowest subband ($x_0(n)$) with a phase-vocoder based time-scaling algorithm. The signals in the higher subband(s) can be processed using a (much more cost-effective) time-domain time-scaling approach. Another option would be to process all the signals with the same time-domain time-scaling algorithm, but with different processing parameters in each subband to account for the different nature of the signals in each of the subbands. This is because the sinusoidal components tend to fall in the low-frequency subbands while high-frequency subbands usually contain more noise-like signals.

For pitch-shifting, one might opt to split the signal into 2 subbands with a cutoff of 8 kHz, and only process the lower subband. The sinusoidal components in the incoming signal would then be pitch-shifted as desired. By contrast, the upper frequency range, which contains noise-like signals, would not be modified, thus preserving the overall brightness of the output signal. When running the phase-vocoder on the subband signals, the size of the Fast Fourier Transform must be adapted to the sampling rate of the subband signals. For example, for a 48 kHz incoming signal that is split into two 24 kHz subband signals, an FFT size of 2048 points would be typical. Because the phase-vocoder is run on a downsampled signal, its cost ends up being a fraction of what it would be if it were run on the original incoming signal. This is where significant savings occurs.

Recombining the subband signals required special consideration. Since different algorithms might be used on the various subband signals, care must be taken to synchronize the modified subband signals before feeding them into the synthesis filterbank 110. For example, the phase-vocoder 106 usually introduces a delay typically equal to half the size of the Fourier transform, while a time-domain algorithm can introduce much smaller delays. If the subband signals are not properly synchronized when input to the synthesis filter bank 110, the resulting modified signal might exhibit unacceptable levels of distortion. The synchronization can be done by calculating the processing delay in each subband, and then equalizing all the delays by means of delay lines 114, as shown in FIG. 1.

Figure 2:
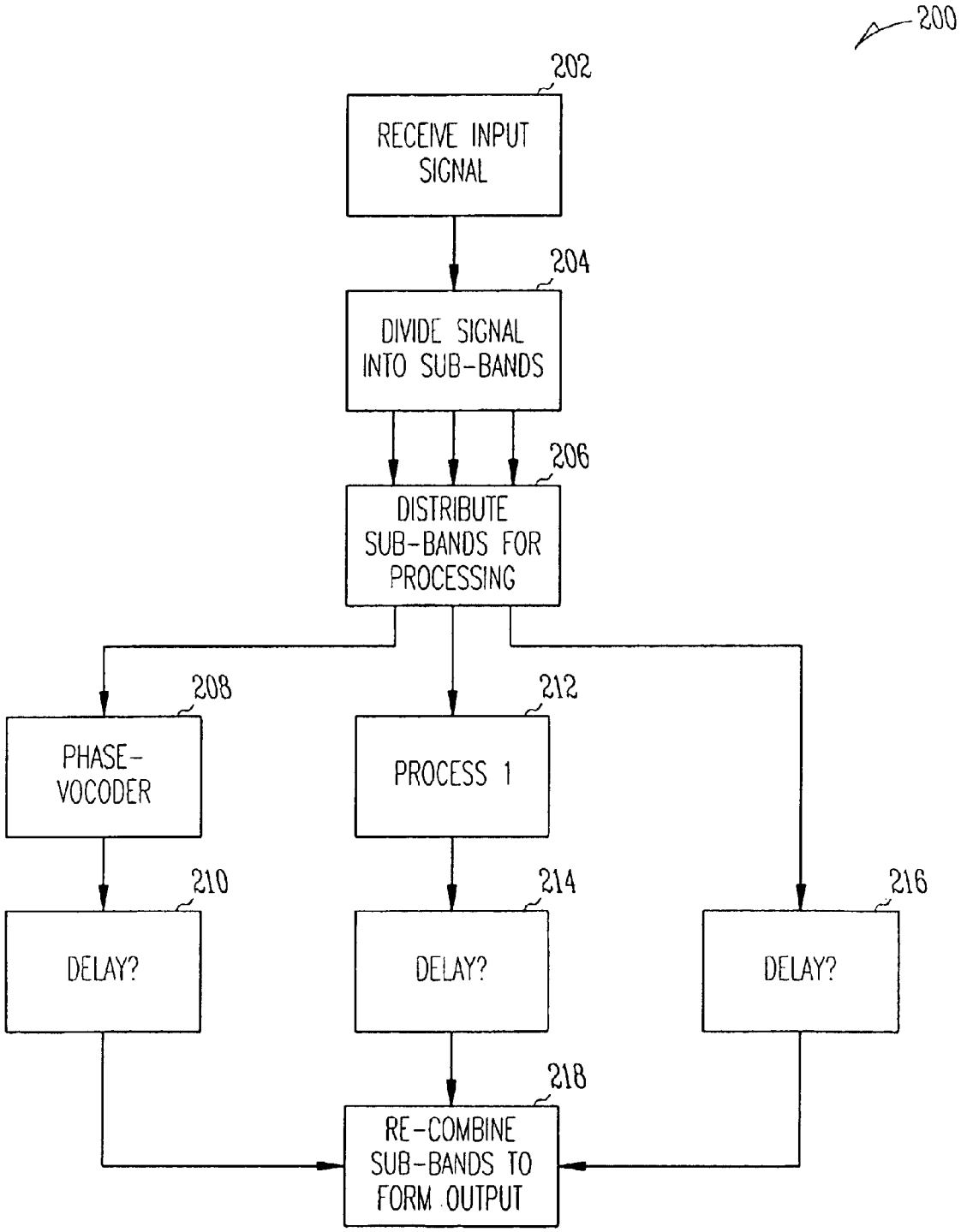
FIG. 2 shows a sub-band processing method 200 for use with the subband phase-vocoder of FIG. 1.

FIG. 2 shows a sub-band phase-vocoder processing method 200 for use with the subband phase-vocoder 100. The processing method 200 can be used to divide an input signal into sub-bands, process the sub-bands and then re-construct the processed sub-bands into an output signal.

At block 202 a time domain signal is input to the analysis filter bank 104. The input includes a frequency region of interest that requires phase-vocoder processing. The input is not constrained to comprise a specific frequency range and may have other regions of interest that are suitable for other types of processing.

At block 204, the input signal is divided into sub-bands by the analysis filter bank 104, wherein each sub-band contains a range of frequencies of the input signal. The sub-bands may comprise adjacent, overlapping or disjoint frequency regions. The sub-bands may also omit frequencies so that some frequency components represented in the input signal do not appear in any of the sub-bands.

At block 206, the sub-bands are distributed from the analysis filter bank 104 for processing by the phase-vocoder 106 and other subband processors. For example, the subband $x_0(n)$ is input to the phase-vocoder 106 for processing, while the subband $x_1(n)$ is input to the processor 1 for processing. The processor 1 may perform time domain processing, such as signal filtering, on the subband $x_1(n)$. The subband $x_0(n)$ is processed by the phase-vocoder 106, however, the processing cost to process a subband is far lower than the processing cost to process the entire input signal.

The method continues with a description of the processing of three different sub-bands. However, the present invention can process any number sub-bands, thus the description is not intended to be limiting, but illustrative of the types of processing possible using embodiments of the present invention.

At block 208, the sub-band $x_0(n)$ undergoes phase-vocoder processing. For example, pitch shifting or signal harmonizing are just two of the processes that may be performed on the sub-band $x_0(n)$ by the phase-vocoder 106.

At block 210, as part of a reconstruction process the output of the phase-vocoder 208 can be optionally delayed by one of the delay blocks 114. This provides a way to compensate for processing delays that may occur in the system. The delay also allows the processed subband output from the phase-vocoder to be synchronized with other processed subbands.

At block 212, the sub-band signal $x_1(n)$ is processed. The processing of the sub-band signal $x_1(n)$ can be any type of time domain process, such as signal filtering for example. The sub-band signal $x_1(n)$ is processed by the processor 1 to form the processed output $y_1(n)$.

At block 214, the processed output $y_1(n)$ may optionally undergo a delay to compensate for delays occurred during processing. The delay may also synchronize the processed output $y_1(n)$ with other subbands.

At block 216, a third sub-band is processed. In this case, the third subband is not required to undergo specific processing, however, it is required to be included in the modified output signal 112. Therefore, the third sub-band signal may only need to go through one of the delay blocks 114 to help synchronize it with other subbands.

At block 218, all the sub-band signals are input to the synthesis filter 110 to combined them to form the output signal 112. Although the output signal 112 comprises all the processed sub-bands, it is not necessary that all the sub-band appear in the output signal 112. Thus, it is possible to divide an input signal into sub-bands, process at least one of the sub-bands using a phase-vocoder (which is cost efficient since the subband is small), process other subbands using other processing techniques, then recombine the sub-bands to create the output signal. It is also possible to create subbands that are not processed at all, but are input to the synthesis filter 110 anyway so that they appear in the output signal 112.

Although described with reference to the specific embodiment of FIG. 1, it will be apparent to those with skill in the art that input signals can be divided into a variety of sub-bands and processed in a variety of ways without deviating from the scope of the present invention.

Figure 3:
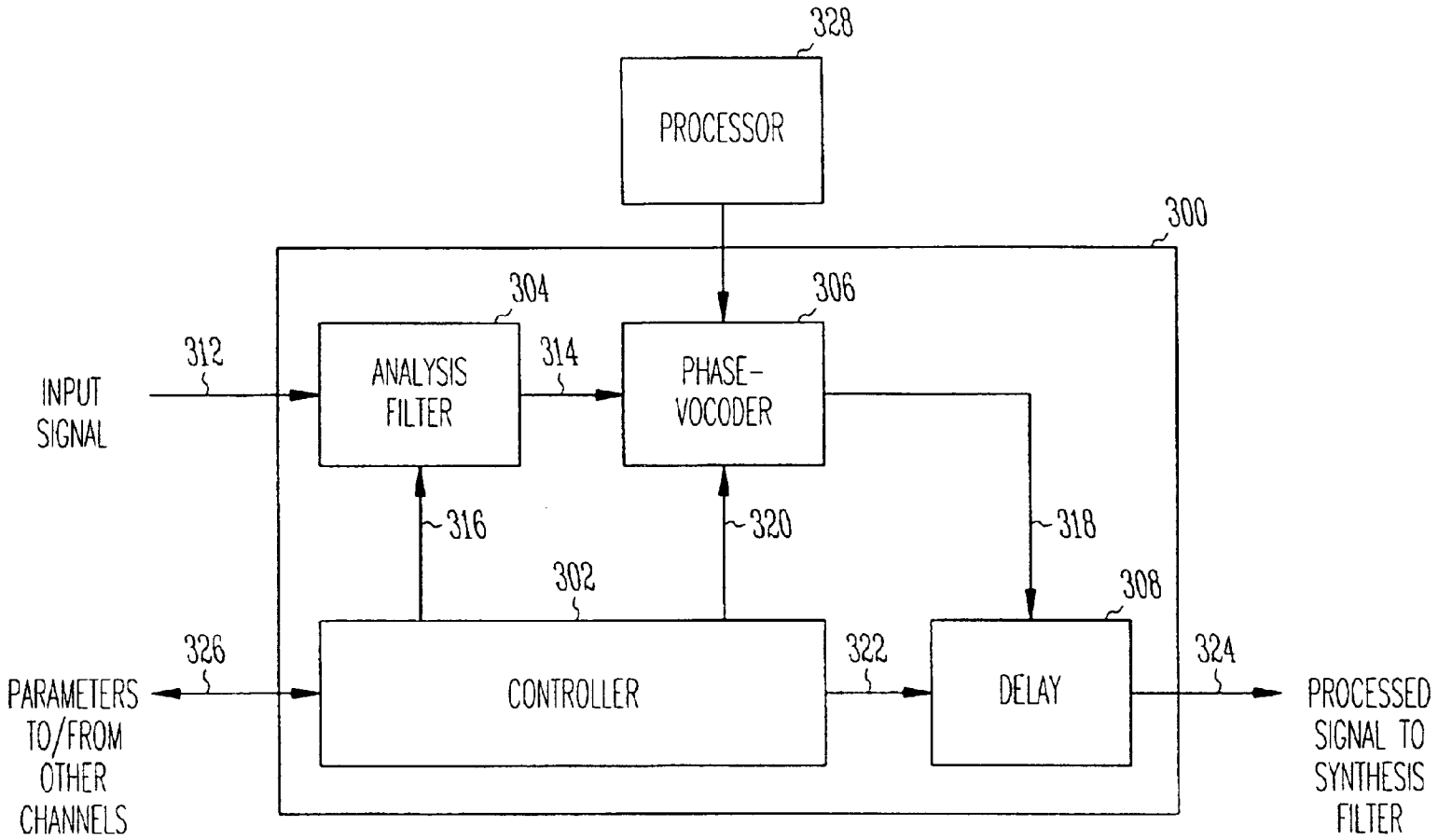
FIG. 3 shows a block diagram of a processing channel 300 constructed in accordance with the present invention.

FIG. 3 shows a block diagram of a processing channel 300 constructed in accordance with the present invention. The processing channel is suitable for use in the apparatus 100 to process one sub-band of an input signal. Thus, a processing apparatus may contain a number of processing channels to process a number of subbands. The processing channel 300 comprises a controller 302, an analysis filter 304, a phase-vocoder 306 and a delay 308.

The controller 302 couples to each of the modules in the processing channel to control the processing of the sub-band signal. The operation of the controller 302 will be described below with respect to each of the modules in the processing channel.

The analysis filter 304 is coupled to receive an input signal 312. The analysis filter 304 filters the input signal to form a subband 314 which is coupled to the phase-vocoder 306. The sub-band 314 includes a region of interest derived from the input signal that contains some or all of the frequency components of the input signal. The region of interest represents a portion of the input signal that is to be processed by the phase-vocoder 306. The controller 302 configures the analysis filter 304 via a filter control line 316 coupled between the controller and the analysis filter 304. The controller configures the analysis filter by setting various filter parameters, such as the pass band, stop band, filter type and so forth.

The phase-vocoder 306 receives and processes the sub-band 314 to form a vocoder output 318. For example, the phase-vocoder 306 may perform frequency domain processes such as pitch shifting, filtering or signal harmonizing. The results of the processing are provided at the vocoder output 318, which is coupled to the delay 308.

The controller 302 controls the phase-vocoder 306 via a vocoder control line 320 coupled between the controller 302 and the phase-vocoder 306. The controller commands the phase-vocoder to perform selected processing functions based on the type of signal processing desired for the sub-band 314.

The delay 308 receives the vocoder output 318 from the phase-vocoder 308 and optionally delays the signal to form a delay output 324, which synchronizes the output of the processing channel 300 with other subbands. For example, if another subband undergoes processing by another processing channel, then the delay 308 can be used to synchronize the phase-vocoder output 318 with the other subband to prevent distortion when the subbands are recombined.

The delay 308 is further coupled to the controller 302 via a delay control line 322. The controller 302 controls the delay 308 to determine the amount of delay to be applied to the vocoder output 318. The controller has a parameter channel 326 that is used to send and receive parameters with other processing channels, so that based on the parameters received by the controller, the amount of delay can be determined.

Thus, the controller 302 operates to coordinate the entire process of filtering the input to form a subband, phase-vocoding the subband and delaying it. The delay output 324 is thereafter provided to a synthesis filter (not shown) where multiple subbands are combined into an output signal.

The processing channel 300 is a portion of a processing system wherein one or more processing channels are combined. In such a processing system the processing channels each process a subband of the input signal. For example, in another processing channel the phase-vocoder 306 is replaced with processor 328. The processor 328 performs subband processing that is computationally less expensive than the phase-vocoder, such as time domain filtering. In a final stage, the processing system has a synthesis filter to combine all the processed subbands into an output signal.

The present invention provides a method and apparatus for reduced cost phase-vocoding of an input signal. It will be apparent to those with skill in the art that the above methods and embodiments can be modified or combined without deviating from the scope of the present invention. Accordingly, the disclosures and descriptions herein are intended to be illustrative, but not limiting, of the scope of the invention which is set forth in the following claims.

What is claimed is:

1. A method for processing an input signal, the method comprising dividing the input signal into at least first and second sub-band signals;

applying a Fourier transform operation to the first sub-band signal to obtain a first resulting signal;

applying a time-domain processing operation to the second sub-band signal to obtain a second resulting signal, wherein the second sub-band signal is not subjected to a Fourier transform operation; and combining the first and second resulting signals into an output signal.

2. The method of claim 1, wherein the step of applying a time-domain processing operation includes a time-scaling operation.

3. The method of claim 1, wherein the step of applying a time-domain processing operation includes passing a sub-band signal without modification so that the second resulting signal is substantially identical to the second sub-band signal.

4. The method of claim 1, wherein the Fourier transform operation includes a phase vocoding operation.

5. The method of claim 1, further comprising time-aligning the resulting signals.

6. The method of claim 5, further comprising combining the time-aligned resulting signals to produce an output signal.

7. The method of claim 6, wherein the step of combining includes a substep of using a synthesis filter bank to produce the output signal.

8. An apparatus for processing an input signal, the apparatus comprising a plurality of filter banks for dividing the input signal into at least first and second sub-band signals;

circuitry for applying a Fourier transform operation to the first sub-band signal to obtain a first resulting signal;

a data path for applying a time-domain processing operation to the second sub-band signal to obtain a second resulting signal, wherein the second sub-band signal is not subjected to a Fourier transform operation; and a recombiner for combining the first and second resulting signals.

9. The apparatus of claim 8 wherein the data path includes circuitry for performing a time-scaling operation.

10. The method of claim 8, wherein the data path passes the second sub-band signal unmodified so that the second resulting signal is substantially the same as the second sub-band signal.

11. The method of claim 8, further comprising a delay for time-aligning the resulting signals.

* * * * *

UNITED STATES PATENT AND TRADEMARK OFFICE

CERTIFICATE OF CORRECTION

PATENT NO. : 6,868,377 B1
DATED : March 15, 2005
INVENTOR(S) : Laroche

It is certified that error appears in the above-identified patent and that said Letters Patent is hereby corrected as shown below:

Title page,
Item [57], ABSTRACT,
Line 8, delete “subbands” insert -- sub-bands -- therefor.

Column 4,
Line 32, delete “subbands” and insert -- sub-bands --, therefor.

Column 5,
Line 52, delete “an” and insert -- a time-domain --, therefor.
Line 53, after “comprising” insert -- receiving the time-domain input signal for processing --.

Column 6,
Lines 1 and 33, after “the” insert -- time-domain --.
Lines 1, 7, 18, 34, 39, 40 and 48, after “second” insert -- time-domain --.
Line 3, after “first” insert -- time-domain --.
Lines 6, 36 and 47, insert -- time-domain -- before “sub-band”.
Line 16, after “a” insert -- time-domain --.
Line 31, delete “an” and insert -- time-domain --, therefor.
Line 33, after “for” insert -- receiving the time-domain input signal and --.
Line 44, after “claim 8” insert -- , --.

Signed and Sealed this

Twentieth Day of September, 2005

JON W. DUDAS
*Director of the United States Patent and Trademark Office*